United States Patent [19]

Strohmaier

[11] Patent Number: 4,526,808

[45] Date of Patent: Jul. 2, 1985

[54] METHOD FOR APPLYING LIQUID TO A YARN

[75] Inventor: Alfred J. Strohmaier, Seaford, Del.

[73] Assignee: E. I. Du Pont de Nemours and Company, Wilmington, Del.

[21] Appl. No.: 269,529

[22] Filed: Jun. 2, 1981

Related U.S. Application Data

[63] Continuation of Ser. No. 55,062, Jul. 5, 1979, abandoned.

[51] Int. Cl.[3] ..... B05D 1/02

[52] U.S. Cl. ..... 427/57; 68/3 SS; 239/102; 427/421; 427/424; 427/426; 118/325

[58] Field of Search ..... 239/102; 68/3 SS; 427/57, 421, 424, 346, 426; 118/57, 234, 325; 8/151.2

[56] References Cited

U.S. PATENT DOCUMENTS

| | | | |
|---|---|---|---|
| 2,855,244 | 10/1958 | Camp | 239/102 |
| 3,137,882 | 6/1964 | Blanchard | 68/3 SS |
| 3,198,170 | 8/1965 | Onishi | 427/57 X |
| 3,496,907 | 2/1970 | Morison | 239/102 X |
| 3,668,905 | 6/1972 | Schlunke | 68/3 SS X |
| 3,783,596 | 1/1974 | Waldkirch | 57/157 F |
| 3,840,391 | 10/1974 | Spitz et al. | 427/57 |
| 4,019,683 | 4/1977 | Asai et al. | 239/102 |

FOREIGN PATENT DOCUMENTS

| | | | |
|---|---|---|---|
| 2151809 | 4/1972 | Fed. Rep. of Germany | 427/57 |
| 43-14995 | 6/1968 | Japan | 427/57 |
| 48-32967 | 10/1973 | Japan . | |
| 48-38915 | 11/1973 | Japan . | |

OTHER PUBLICATIONS

A Small Ultrasonic Atomizer for Liquid Fuels, Hunter, Ultrasonics, Jan. 1969, pp. 63 & 64.

IEEE Transactions on Sonics and Ultrasonics, Perron, vol. su-14, No. 4, Oct., 1967, pp. 149-153.

Partial Translation of Japan Application NS 7213/76, 1/21/76 (1 Paragraph).

Ultrasonic Atomizers in the Chemical Industry, Ultrasonics, 1971 Science and Technology Press Ltd., Survey, 1971, pp. 24-29.

Ultrasonic Atomization of Liquid Fuels, Journal of Fuel and Heat Technology, London, 14, 1966, Bradbury.

Ultrasonic Atomizer Incorporating a Self-Acting Liquid Supply, Lierke, Ultrasonics, vol. 5, 214 (1967).

Research and development, Ultrasonics, vol. 6, Jul. 1968, p. 115.

*Primary Examiner*—Shrive P. Beck

[57] ABSTRACT

An ultrasonic vibrator of the type used to atomize liquid is used for applying liquid finish to a moving threadline. The liquid is supplied to a through passage in the tip of the horn of the vibrator in which it is atomized and applied to the threadline which is moving through the passage in the tip of the horn.

19 Claims, 18 Drawing Figures

METHOD FOR APPLYING LIQUID TO A YARN

This is a continuation of application Ser. No. 55,062, filed July 5, 1979, now abandoned.

DESCRIPTION

1. Technical Field

This invention generally relates to the manufacture of synthetic fibers, and more particularly, to an improved method and apparatus for applying liquid finishes to yarns, ribbons and tows.

2. Background Art

In the manufacture of synthetic yarns, it is a common practice to apply a composition of chemical ingredients in liquid form to threadlines of the yarn.

Conventionally, these liquid finishes are applied by advancing the running yarn threadline in contact with the surface of a roll rotated in a liquid reservoir containing the desired finish or by means of stationary applicator tips or sprays supplied from metering pumps. Finish compositions have traditionally been limited to low viscosity solutions or emulsions of oils in (large amounts of) water. Neither the low viscosity nor the water are always required by the fiber, but are dictated by the above-noted conventional finish applicators which are incapable of handling high-viscosity fluids adequately and without imposing excessive drag upon the threadline. Nonaqueous replacements for water that are nontoxic, nonflammable and low cost are unavailable. Thus, current textile technology is somewhat limited by the shortcomings of the conventional finish applicators. These have imposed limitations in the processing of fibers, restricted the available products and added to the cost of fiber production. In addition, some of the aqueous finishes have poor roll wetting properties and others suffer from poor emulsion stability.

SUMMARY OF THE INVENTION

This invention provides a new dimension for finish application to a threadline of yarn which alleviates the above shortcomings. The method and apparatus of the invention has the capability of applying low and high viscosity fluids of all types and compositions whether aqueous or nonaqueous, homogeneous or nonhomogeneous, emulsifiable or nonemulsifiable, wetting or nonwetting, etc. The method involves supplying a liquid finish in a continuous metered stream to an atomizing surface on the tip of an ultrasonic vibrator then atomizing and propelling the liquid onto the yarn by means of the vibrator while the threadline is being passed in close proximity to the tip of the vibrator. Gear pumps are utilized to supply precisely metered streams of finish or ingredients per threadline to the vibrating finish applicators. Where two or more fluid streams are required per threadline the fluids are supplied in metered streams to a mixing zone immediately ahead of the point of application where they are blended prior to or during atomization or they may proceed directly to the tip of the applicator as separate streams. In a preferred embodiment of the apparatus the through passage in the tip of the ultrasonic vibrator is formed to converge the filaments of the threadline into a coherent bundle and an angled slot is provided in the tip leading into the through passage to facilitate stringup.

In addition to atomizing and propelling the liquid finish onto the yarn, the vibrations also warm the finish slightly, homogenize separate finish ingredients, clean the orifice in the atomizing surface of the tip of the vibrator and minimize yarn friction within the vibrating finish applicator.

DETAILED DESCRIPTION OF THE ILLUSTRATED EMBODIMENTS

Figure 1:
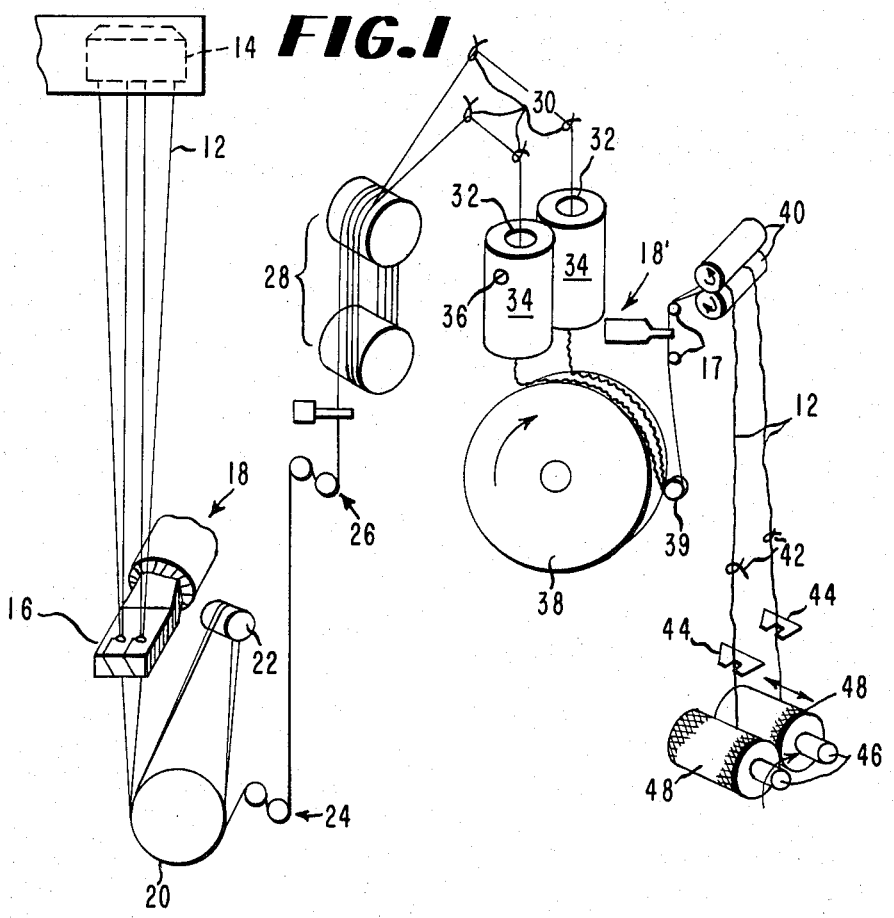
FIG. 1 is a schematic drawing showing use of the subject finish applicators at two locations in a yarn manufacturing operation.

The process chosen for purposes of illustration in FIG. 1 includes a yarn 12 being spun as two separate threadlines from a spinneret 14 and each threadline is forwarded through the passages in the tip of the horn 16 of a first vibrating finish applicator generally designated 18. Next the threadline passes around feed roll 20 and its associated separator roll 22 around draw pin assembles 24, 26 to draw rolls 28 where it is forwarded by the rolls 28 at a constant speed through yarn guides 30 and through the yarn passageways 32 of the jet bulking devices 34. In the jets 34 the threadlines 12 are subjected to the bulking action of a hot fluid directed through inlets 36 (only one shown). The hot fluid exhausts with the threadline against a rotating drum 38 having a perforated surface on which the yarn cools to set the crimp. From the drum the threadlines in bulky form pass to a guide 39 and in a path over a pair of guides 17 past the end of the second vibrator 18' then to a pair of driven take-up rolls 40. Bulky yarns of this type are disclosed in U.S. Pat. No. 3,186,155 to Breen and Lauterbach. The threadlines are then directed through fixed guides 42 and traversing guides 44 onto rotating cores 46 to form packages 48.

Figure 2:
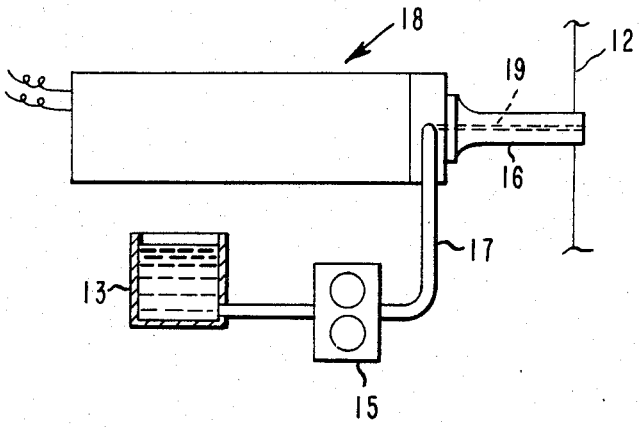
FIG. 2 is a schematic side elevation view of the vibrator used as a finish applicator at a first location.
Figure 4:
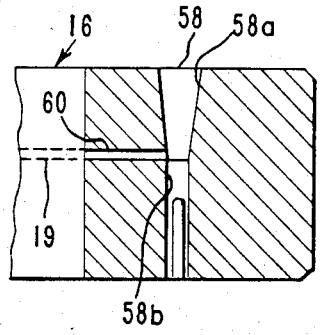
FIG. 4 is a section of FIG. 3 taken along line 4—4.
Figure 3:
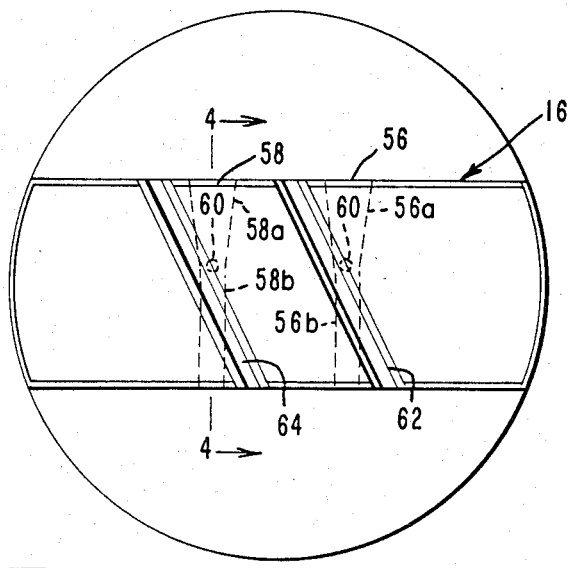
FIG. 3 is an end view of the tip of a vibrator at the first location.
Figure 5:
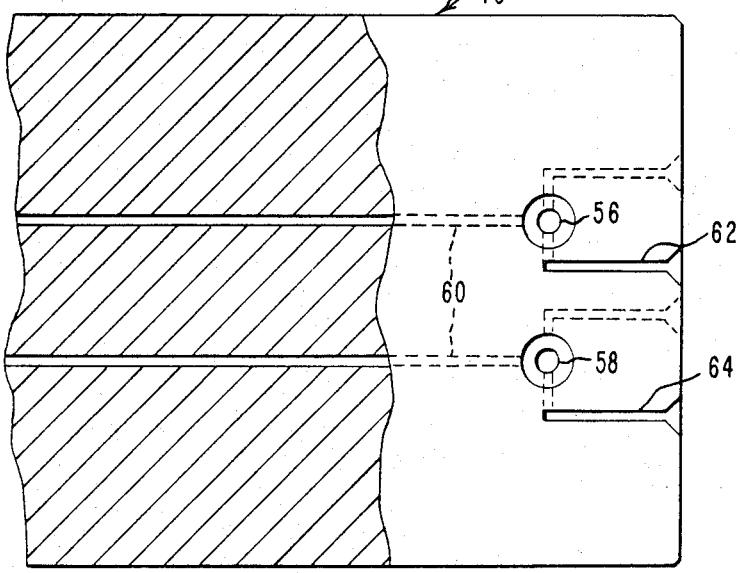
FIG. 5 is a top view of FIG. 3.

In FIG. 2 the vibrating finish applicator 18 is supplied with liquid finish by means of a gear pump 15 connected to a reservoir 13. The gear pump supplies a precisely metered stream of liquid finish via pipe 17 to an internal axial passage 19 in the horn 16. A closed applicator tip inside of which the yarn 12 meets the finish is either mounted on the end of or forms an integral part of the horn of the ultrasonic vibrator. This structure is shown in more detail in FIGS. 3–5 wherein the horn 16 has a pair of through passages 56, 58 each formed of successive tapered and cylindrical lengths designated 56*a*, 56*b* and 58*a*, 58*b* respectively. The passages 19 are connected to through passages 56, 58 via orifices 60 and angled slots 62, 64 are provided in communication with through passages 56, 58 respectively to facilitate stringup of continuous threadlines into the passages.

In operation the liquid to be atomized and applied to the threadline 12 is precisely metered by pump 15 from reservoir 13 into the passages 19 in the horn 16. The liquid flows onto a portion of the inner surface of passages 56, 58 through orifices 60 as a thin film then vibration of the thin liquid film breaks up or atomizes the liquid in the passages 56, 58 and propels it onto the threadlines moving through the passages. The vibrations of the horn are also transmitted to the threadline to reduce yarn friction in the passages at the tip of the horn and to aid in uniformly spreading the finish on the filaments of the threadline. The vibration of the tip atomizes the liquid and propels the atomized mist into the yarn bundle by disturbing the gas boundary layer accompanying the moving threadline. This makes the threadline more receptive to the liquid and aids in uniformly distributing the liquid on and around the individual filaments in the yarn threadline.

The ultrasonic generator may be piezoelectric or magnetostrictive having a frequency in the range of from 10 to 100 KHZ, but preferably in the range of 20 to 50 KHZ.

Figure 6:
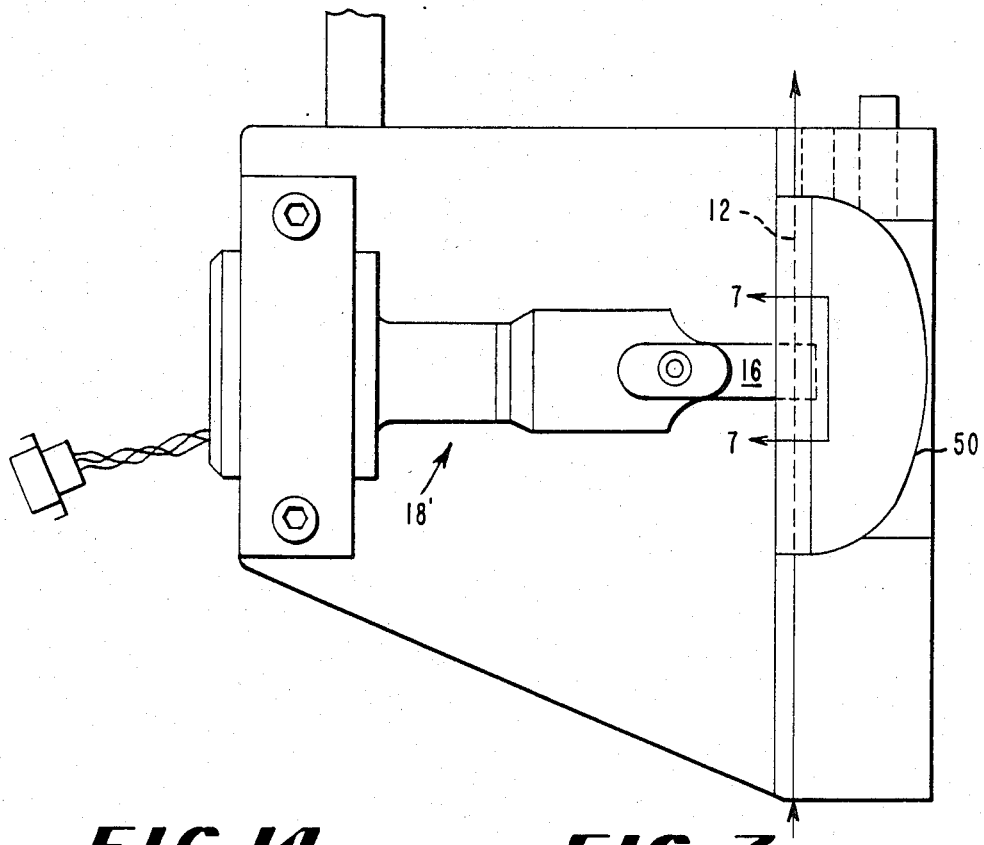
FIG. 6 is a schematic side elevation view of the vibrator used as a finish applicator at a second location in the yarn bulking operation.
Figure 7:
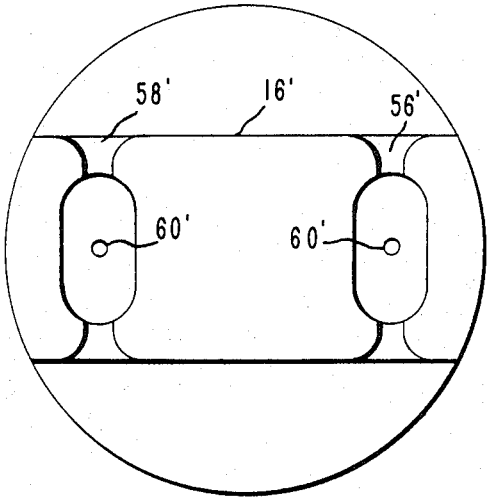
FIG. 7 is a section of FIG. 6 taken along line 7—7.
Figure 8:
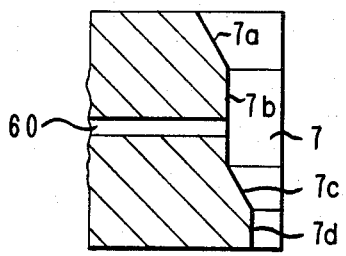
FIGS. 8 through 11*a* are side and front elevation views of the end of the horn for various open tip designs used when a single rather than multiple yarn threadline is to be treated with liquid.
Figure 8A:
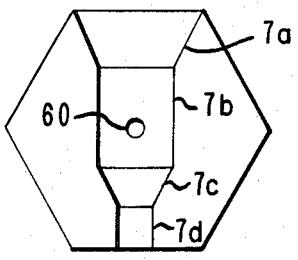

FIG. 6 shows the vibrator 18' located at the second location in the operation. This vibrator differs from the one described in FIGS. 2–5 in that horn 16' has an open tip design with two open-sided bottle-shaped passages 56', 58' in communication with liquid supply orifices 60' (FIG. 7). In addition, a shield 50 shaped as a hollow hemisphere with slots for the threadlines to pass through is positioned beyond the tip of the horn to collect excess liquid that may not be deposited on the yarn.

Figure 9:
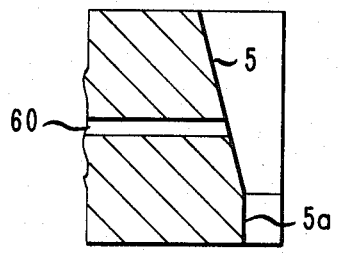
Figure 9A:
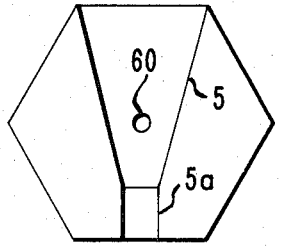
Figure 10:
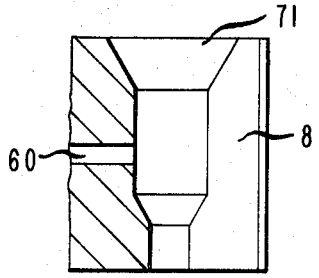
Figure 10A:
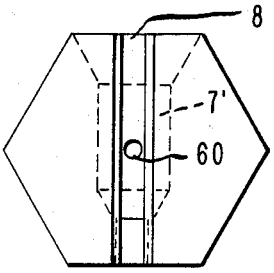
Figure 11:
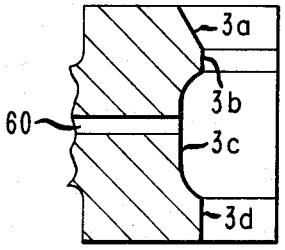
Figure 11A:
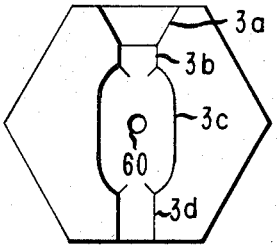

FIGS. 8, 8*a*, 9, 9*a* and 11, 11*a* are side and front elevations of the tips of horns having open-sided passages for yarn with various combinations of tapered, spherical and cylindrical lengths. These horns are illustrated for use with single threadlines however, multiple threadline passage construction can also be achieved. More particularly, FIGS. 8, 8*a* disclose an open-sided tip with a groove 7 having successive tapered, cylindrical, tapered and reduced cylindrical lengths designated *7a, 7b, 7c* and *7d* respectively. FIGS. 10 and 10*a* illustrate a tip with an enclosed passage 7' with a stringup slot 8 leading into the passage. The passage has the same configuration as the groove shown in FIGS. 8, 8*a*, i.e. successive tapered, cylindrical, tapered and reduced cylindrical lengths. In FIGS. 9 and 9*a* the tip has a groove with successive tapered and cylindrical lengths 5 and 5*a* while FIGS. 11, 11*a* illustrate the groove with successive tapered, cylindrical, spherical and cylindrical lengths designated *3a, 3b, 3c* and *3d* respectively.

Figure 14:
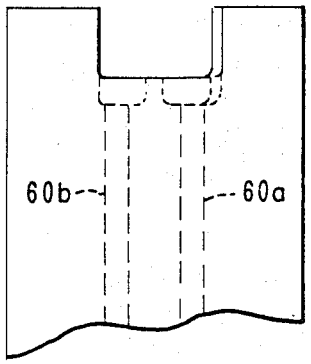
FIGS. 12, 13 and 14 are top and end elevation views of a horn for use when treating a single yarn threadline with two separate streams of liquid.
Figure 12:
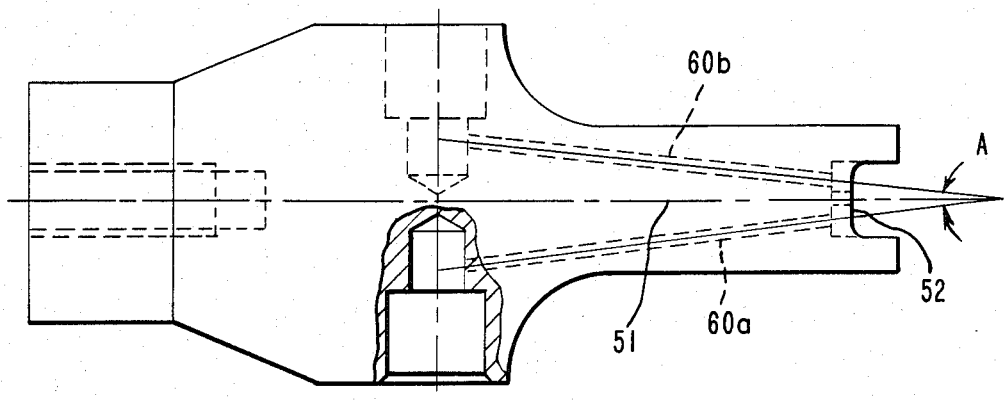
Figure 13:
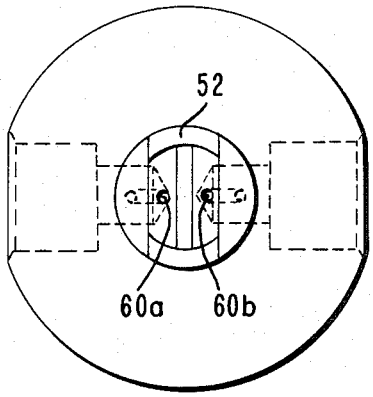

Although a single liquid stream per threadline has been illustrated, two or more liquid streams per threadline are contemplated. These may be transported to a mixing zone immediately ahead of the point of application by multiple passages inside the vibrating horn 16 allowing separation of the liquid streams until a location just ahead of where orifices 60 enter the through passages 56, 58. Another configuration for handling more than one metered stream per threadline is shown in FIGS. 12, 13 and 14 wherein separate liquid supply passages 60*a* and 60*b* lead to the inner surface of yarn slot 52 in the end of the horn. These passages may be angled in relation to each other as in FIG. 12 or may be parallel to each other as in FIG. 14.

An additional feature of the applicators in FIGS. 12 and 14 is that the yarn bundle is spread out evenly across the tip surface to enhance the treatment of the individual filaments.

EXAMPLE 1

Polyhexamethylene adipamide having a relative viscosity of about 63 is melt spun into a yarn containing 68 filaments and processed using apparatus similar to that shown in FIG. 1 except that a second vibrating applicator 18' is not used. The spun filaments are passed through the tip of a vibrating finish applicator 18 operating at 20 KHz and are forwarded to a feed roll running at a surface speed of 680 yards (624 meters) per minute. The applicator tip has the configuration shown in FIG. 3. A yarn finish is metered to the applicator tip where it is atomized and propelled into the yarn bundle which is in contact with the vibrating tip. The finish is a combination of an oily lubricating composition and water. Combinations containing 7.5%, 15%, 30%, 50% and 90% by weight of the lubricating composition are used. The combinations are found to have the following Brookfield viscosities: 7.5%, 3.5 centipoises; 10%, 3.8 centipoises; 15%, 4.2 centipoises; 30%, 8.3 centipoises; 50%, 144.8 centipoises; and 90%, 1,100 to 1,200 centipoises. The meter pump is operated to apply calculated amounts of 0.25%, 0.5%, 0.75% and 1.00% by weight, based on the weight of the yarn, of the lubricating composition for each of the combinations. The concomitant amounts of water thus applied to the fiber were also calculated and are listed in Table I. The treated yarn was then drawn to a denier of 1350 by draw rolls running at a surface speed of 2154 yards per minute (1976 meters/minute), then bulked and wound up. When conditions permitted, each run was continued for 20 minutes before the package was doffed; runs less than 20 minutes are indicative of troublesome operation. Table II shows that the process operated surprisingly well even with the 50% and 90% solutions which would have been too viscous for application by current normal means. Measurement of the resulting yarns indicated the effects of the applied water upon yarn bulk, dyeability and quality, thus effectively demonstrating the extreme versatility and utility of this new method of finish application.

EXAMPLE 2

A 1300 denier yarn is prepared in a manner similar to that described for (1) above except that the tip has only one hole and water and an oily lubricating composition are metered separately and the metered streams combined just prior to entry to the applicator. The lubricating composition is metered at 1.85 grams per minute and the water is metered at 5.58 grams per minute. The process runs well. When the lubricating combination is emulsified in water in a separate step for roll application, it has poor emulsion stability and does not wet the roll well.

EXAMPLE 3

A 1300 denier yarn is prepared in a manner similar to that described for (1) above except that a second vibrating applicator 18', operating at 50 KHz, is used between the drum and the forwarding rolls. A yarn finish containing 15% of an oily lubricating composition is applied from the second vibrating applicator. The yarn finish is metered at a rate to provide 0.65% by weight, based on the weight of the yarn, of the lubricating composition to the yarn. The yarn that is removed from the drum is essentially dry so that a measure of the moisture level of the yarn after it has passed the applicator is a measure of the amount of finish applied. The moisture measurement is a conductivity measurement and shows a significant increase when the vibrating applicator is in operation over when the vibrating applicator is not vibrating.

TABLE I

| amount of finish applied to yarn | wt. percent water on yarn wt. percent of lubricating composition in the finish | | | | |
|---|---|---|---|---|---|
| wt. percent | 90 | 50 | 30 | 15 | 7.5 |
| 0.25 | 0.028 | 0.25 | 0.58 | 1.42 | 3.08 |
| 0.50 | 0.056 | 0.50 | 1.17 | 2.83 | 6.17 |
| 0.75 | 0.083 | 0.75 | 1.75 | 4.25 | 9.25 |
| 1.00 | 0.111 | 1.00 | 2.33 | 5.67 | 12.33 |

TABLE II

| amount of finish applied to yarn | Doff length minutes wt. percent of lubricating composition in the finish | | | | |
|---|---|---|---|---|---|
| wt. percent | 90 | 50 | 30 | 15 | 7.5 |
| 0.25 | 20 | 20 | 20 | 20 | 20 |
| | 5 | 20 | 20 | 17 | 20 |
| | 20 | 20 | 20 | 20 | 20 |
| | 20 | | | | |
| | 13 | | | | |
| 0.50 | 12 | 20 | 20 | 20 | 20 |
| | 4 | 20 | 20 | 20 | 20 |
| | 20 | 20 | 20 | 20 | 13 |
| | 20 | | 20 | | |
| | | | 20 | | |
| | | | 20 | | |
| 0.75 | 18 | 20 | 20 | 20 | 15 |
| | 20 | 20 | 20 | 20 | 20 |
| | 16 | 16 | 10 | 20 | 5 |
| 1.00 | 20 | 7 | 10 | 20 | 1 |
| | 20 | 4 | 20 | 16 | 2 |
| | 20 | 4 | 20 | 20 | |

I claim:

1. A method for applying a liquid to a threadline comprising: supplying liquid in a metered stream to an atomizing surface of a passage through the tip of a horn of an ultrasonic vibrator; vibrating said horn to atomize said liquid and produce a mist; and moving said threadline in a path through said passage in such close proximity to said atomizing surface that said mist is propelled onto said threadline.

2. The method of claim 1, said liquid being supplied to said atomizing surface in separate metered streams which are joined at a location just prior to reaching said atomizing surface.

3. The method of claim 1, said liquid being formed of separate metered streams of oil and water.

4. The method of claim 3, said oil being water insoluble.

5. The method of claim 3, said oil being emulsifiable.

6. The method of claim 1, said liquid being formed of different oils.

7. The method of claim 1, said liquid being supplied to said atomizing surface in separate metered streams.

8. A method of applying a liquid to a threadline comprising: supplying the liquid in a continuous metered stream to a through passage in the tip of an ultrasonic vibrator; atomizing the liquid in said through passage by means of said vibrator; and vibrating the threadline by means of said vibrator while forwarding it through said through passage.

9. The method of claim 8, said liquid being supplied to said atomizing surface in separate metered streams.

10. The method of claim 8, said liquid being supplied to said atomizing surface in separate metered streams which are joined at a location just prior to reaching said atomizing surface.

11. The method as defined in claim 8, said liquid being formed of separate metered streams of water and oil.

12. The method of claim 11, said oil being water insoluble.

13. The method of claim 11, said oil being emulsifiable.

14. A method of applying a liquid to a threadline comprising: supplying the liquid in a continuous metered stream to a through passage in the tip of an ultrasonic vibrator; atomizing the liquid to produce a mist in said through passage by means of said vibrator; and forwarding the threadline through said through passage in contact with said tip.

15. The method of claim 14, said liquid being supplied to said atomizing surface in separate metered streams.

16. The method of claim 14, said liquid being supplied to said atomizing surface in separate metered streams which are joined at a location just prior to reaching said atomizing surface.

17. The method as defined in claim 14, said liquid being formed of separate metered streams of water and oil.

18. The method of claim 17, said oil being water insoluble.

19. The method of claim 17, said oil being emulsifiable.

* * * * *